US009440230B2

(12) United States Patent
Baron

(10) Patent No.: US 9,440,230 B2
(45) Date of Patent: Sep. 13, 2016

(54) SAMPLING PIPETTE WHICH DETECTS THE PASSAGE OF THE PISTON THROUGH A PREDETERMINED POSITION

(71) Applicant: Gilson SAS, Villiers le Bel (FR)

(72) Inventor: Stéfen Baron, St. Leu la Foret (FR)

(73) Assignee: Gilson SAS, Villiers le Bel (FR)

( * ) Notice: Subject to any disclaimer, the term of this patent is extended or adjusted under 35 U.S.C. 154(b) by 0 days.

(21) Appl. No.: 14/377,967

(22) PCT Filed: Feb. 13, 2013

(86) PCT No.: PCT/EP2013/052807

§ 371 (c)(1),
(2) Date: Aug. 11, 2014

(87) PCT Pub. No.: WO2013/120862

PCT Pub. Date: Aug. 22, 2013

(65) Prior Publication Data

US 2015/0004078 A1 Jan. 1, 2015

(30) Foreign Application Priority Data

Feb. 13, 2012 (FR) ..... 12 51329

(51) Int. Cl.
*B01L 3/02* (2006.01)

(52) U.S. Cl.
CPC ..... *B01L 3/0237* (2013.01); *B01L 3/0217* (2013.01); *B01L 2200/143* (2013.01); *B01L 2300/02* (2013.01); *B01L 2300/023* (2013.01)

(58) Field of Classification Search
CPC ..... B01L 3/0227; B01L 3/0237
USPC ..... 422/501, 516
See application file for complete search history.

(56) References Cited

U.S. PATENT DOCUMENTS 4,369,665 A * 1/1983 Citrin ..... 73/864.18
4,567,780 A 2/1986 Oppenlander et al.

(Continued)

FOREIGN PATENT DOCUMENTS

EP 0864364 9/1998
WO WO/01/76749 10/2001
WO WO 2005/050554 6/2005

OTHER PUBLICATIONS

International Search Report for Intl. Pat. Appl. No. PCT/FR2001/001069, issued on Jul. 20, 2001, 6 pp. (English language translation provided).

(Continued)

*Primary Examiner* — Paul Hyun
(74) *Attorney, Agent, or Firm* — Miles & Stockbridge P.C.

(57) ABSTRACT

A manually actuated sampling pipette including a piston designed to undergo a dispensing movement during which a first elastic return is loaded, followed by a purge movement during which a second elastic return is loaded, and comprising an electronic device that receives a switching signal notifying passage of the piston through a predetermined position along its dispensing distance or its purge distance, position in which the elastic returns have a predetermined deformation. The pipette also includes a switch that outputs the signal to the electronic device. Furthermore, an elastic support is included which is capable of deforming under the effect of the axial pressure applied by the operator, and the pipette is designed such that deformation of the support, generating switching, is caused when the intensity of the axial pressure is greater than the intensity bringing the elastic returns to their predetermined strain level.

19 Claims, 7 Drawing Sheets

(56) References Cited

U.S. PATENT DOCUMENTS

| | | | | |
|---|---|---|---|---|
| 4,658,116 | A * | 4/1987 | Tsang et al. | 392/385 |
| 4,905,526 | A | 3/1990 | Magnussen, Jr. et al. | |
| 5,998,218 | A | 12/1999 | Conley et al. | |
| 6,254,832 | B1 | 7/2001 | Rainin et al. | |
| 2009/0000350 | A1 | 1/2009 | Magnussen et al. | |
| 2009/0074622 | A1 | 3/2009 | Kalamakis et al. | |

OTHER PUBLICATIONS

International Preliminary Report on Patentability for Intl. Pat. Appl. No. PCT/FR2001/001069, issued on Jul. 15, 2002, 13 pp. (English language translation provided).

International Search Report and Written Opinion issued in PCT/EP2013/052807, May 10, 2013.

* cited by examiner

SAMPLING PIPETTE WHICH DETECTS THE PASSAGE OF THE PISTON THROUGH A PREDETERMINED POSITION

CROSS-REFERENCE TO RELATED APPLICATIONS

This application is a National Stage Entry under 35 USC 371 of International Application No. PCT/EP2013/052807, filed Feb. 13, 2013, which claims the benefit of FR Patent Application No. 1251329, filed Feb. 13, 2012, the contents of which are herein incorporated by reference.

TECHNICAL FIELD

The invention relates to the field of sampling pipettes, also called laboratory pipettes or liquid transfer pipettes, designed for sampling and dispensing liquid in containers or similar devices.

Pipettes concerned by this invention are manually actuated pipettes. These pipettes are designed to be held by an operator in one hand during liquid sampling and dispensing operations, these operations being done by moving a control button by applying an axial actuation pressure on this button.

More specifically, the invention relates to pipette means for detection of the piston passing through a predetermined position along its dispensing movement or its purge movement.

STATE OF PRIOR ART

Being able to detect the passage of the piston through a predetermined position is useful in many respects. For example, it can be used to verify a count of the number of pipetting operations made with a single pipette as disclosed in document WO01/76749. This document discloses the principle by which a signal is emitted when the piston has reached its travel stop, for counting purposes.

This is done by providing a switch comprising contacts 118 onboard the sliding mobile piston. During operation, these contacts are moved by a length equal to the total length of the piston movement, at the end of which the contacts 118 will switch through a conducting bridge fixed onto the pipette body.

Thus, the long travel distance required for contacts 118 makes it difficult to install them, particularly due to the necessary presence of electrical wires 120 which must be sufficiently long to tolerate the movement between the fixed microprocessor 84 and the low point of the contacts 118. This also introduces a risk of failure because there is a risk that electrical wires 120 can be trapped during displacements of the pipette piston.

It should be noted that detection of the piston passing through a predetermined position may have other applications than counting pipetting cycles. Other application examples are described below. Nevertheless in existing solutions, the means adopted for detection of the piston passing through a predetermined position can always be improved, regardless of which application is selected.

OBJECT OF THE INVENTION

Therefore, the purpose of the invention is to at least partially overcome the disadvantages mentioned above related to embodiments according to prior art.

To achieve this, the purpose of the invention is a manually actuated sampling pipette comprising a control rod, the lower end of which controls displacement of a piston housed in a suction chamber of the pipette and free to slide in it, the top end of the control rod being provided with a control button that will be moved by axial actuation pressure of an operator so that the piston undergoes a dispensing movement during which the first elastic return means are loaded, followed by a purge movement during which the second elastic return means are loaded, said pipette comprising an electronic device that will receive a switching signal notifying passage of the piston through a predetermined position along its dispensing distance or its purge distance, position in which said first and/or second elastic return means have a predetermined deformation, the pipette also including a switch that outputs said switching signal to said electronic device when activated by switching control means.

According to the invention, said control means comprise a mobile actuation device fixed to an elastic support capable of deforming elastically under the effect of said axial actuation pressure applied by the operator on the control button, said pipette being designed such that elastic deformation of the support bringing the mobile device from an inactive position into an actuation position, is caused only when the intensity of said axial pressure is greater than or equal to the intensity bringing said first and/or second elastic means to their predetermined strain level.

The principle of the invention is based on creation of a judicious correlation between the stiffnesses of the first and second return means and of the deformable elastic support. The deformable elastic support is designed so that it can only deform and start switching when the axial pressure applied to it is sufficiently high so that it has firstly created a deformation of the first and/or second elastic return means so that the pipette piston has reached its predetermined position that has to be detected.

Therefore, the invention has the advantage that the piston travel length and the length of the relative displacement between the fixed and mobile contacts of the switch are no longer identical. The result is greater reliability, easier installation and a much smaller risk of failure.

As will be disclosed below, some or all of the detection means mentioned above are preferably integrated into the control button. It is easy to install them there, and this solution makes it easy to apply the invention on all existing pipettes without excessively changing the initial design. Nevertheless, the system may be installed elsewhere in the pipette, preferably at least partly in the control button, but also in other appropriate locations. For example, the switch and its control means may be located between the bottom end of the control rod and the piston.

There are several possible applications for the invention, such as counting the number of pipetting cycles, this number possibly being stored in memory and/or displayed on the pipette, but also it is possible to order any action after detection of the piston passing through the predetermined position, or send a signal that will be received by any device designed for remote communication with the pipette. In this context, any wireless connection type may be envisaged without going outside the scope of the invention.

The predetermined position of the piston is chosen as a function of the required applications. It may thus be selected at any location between the beginning of the dispensing movement and the end of the purge movement, including the low point of this purge movement.

Preferably, said elastic support is designed to deform suddenly when it brings the mobile device from the inactive position into the actuation position.

Preferably, said elastic support is dome-shaped, with the hollow part of the dome facing the bottom of the pipette. Thus, as the dome is deformed causing switching, the orientation of the concave part of the dome is reversed, preferably suddenly as mentioned above.

Preferably, said elastic support is integrated into said control button and forms the part of the button on which the operator directly applies the axial actuation pressure during a pipetting operation. In other words, it forms an upper part of the external casing of the plug, but alternatively the axial pressure could be applied to it only indirectly if it were covered by another element, for example a flexible membrane closing the upper part of the button.

Preferably, said mobile device fixed to the elastic support is a pin. Alternately, it could be a central portion of the dome.

Preferably, said first and second elastic return means are compression springs, as is conventionally the case for existing manually actuated pipettes.

As mentioned above, at least some of the following elements and preferably all of these elements are integrated into the control button:

said electronic device;

said switch;

said control means; and an electrical power supply to the electronic device.

Preferably, said electronic device comprises a microprocessor or similar, and preferably also a transmitter.

This means that the electronic device can be designed to perform at least one of the following actions:

Store the number of switching signals output by said switch, and possibly data related to these switching signals such as the date, time, etc. This storage is provided essentially for counting the number of pipetting cycles done by the pipette.

control an action following the output of a switching signal by said switch, for example measurement of a physical data such as pressure, temperature, mass of sampled liquid, etc.

control a change to the display on a screen provided on a pipette after said switch has output a switching signal. For example, the display may indicate the number of pipetting operations since the last reset.

use a transmitter to send a transmission signal to a receiver located at a distance from the pipette through a wireless link, after the switch has output a switching signal. In this case, it may be a receiver installed on any type of device capable of remote communication with the pipette such as a lighting device to help dispense liquid in the wells of at least one microtitration plate that will be supported on this lighting device.

Preferably, said predetermined position of the piston corresponds to the transition position between the dispensing movement and the purge movement, or a position close to this transition position. Although other positions can be envisaged, the transition position is particularly appropriate when the objective is to detect that liquid has been completely dispensed.

Another purpose of the invention is a system comprising a sampling pipette like that described above, and a lighting device to help dispense liquid in the wells of at least one titration device designed to be supported on the lighting device, this lighting device being designed to be illuminate said wells successively in response to the transmission signals sent through a wireless link by said electronic device of the pipette. In this case once again, the wireless link may be of any type known to those skilled in the art, for example RF, optical, etc.

Finally, another purpose of the invention is a manually actuated control button integrating the invention described above. Thus, this button will be fixed to the top end of a control rod of the pipette, the bottom end of which will control displacement of a pipette piston, said control button having a top surface on which an operator who would like to perform a dispensing movement followed by a purging movement of the piston can apply an axial actuation pressure.

According to the invention, said button comprises an electronic device and a switch which, when actuated by the switching control means also integrated into the button, outputs a switching signal to said electronic device, said control means comprising a mobile actuation device fixed to an elastic support capable of deforming elastically under the effect of said axial actuation pressure applied by the operator on the control button, said button being designed such that elastic deformation of said support bringing the mobile device from an inactive position to an actuation position is only caused when the intensity of said axial pressure applied on said top surface is greater than a predetermined intensity.

All optional characteristics described above may be included in this control button, without going outside the scope of the invention. For example, the button also integrates an electrical power supply for the electronic device.

Other advantages and characteristics of the invention will become clear after reading the detailed non-limitative description given below.

BRIEF DESCRIPTION OF THE DRAWINGS

This description will be given with reference to the appended drawings among which.

DETAILED PRESENTATION OF PREFERRED EMBODIMENTS

Figure 1:
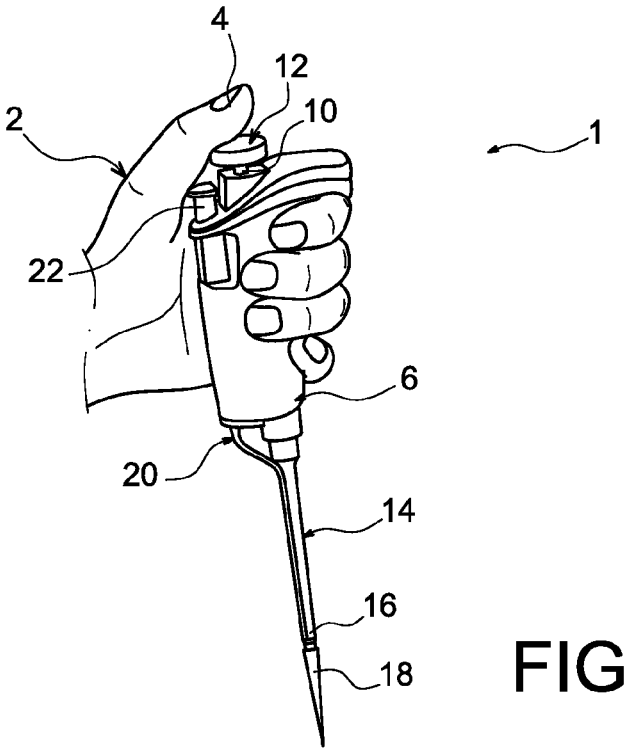
FIG. 1 shows a perspective view of a manually actuated sampling pipette according to this invention, when it is actuated by an operator.

FIG. 1 shows a manually actuated sampling pipette 1 held in an operator's hand 2, the operator using his thumb 4 to actuate the pipette to dispense previously drawn in liquid.

More precisely, the pipette 1 comprises a handle 6 forming the upper body of the pipette, handle from which a control rod 10 projects carrying a control button 12 at its top end in the pipetting position, on the top part of which the operator will press with his thumb. Note that a display screen (not shown) may be provided on the handle 6.

Under the handle 6, the pipette 1 comprises a removable low part 14 that is terminated near the bottom by a cone support end piece 16 onto which a consumable 18, also called the sampling cone, fits. After pipetting, the cone may be ejected by an ejector 20 mechanically in a known manner, the actuation button 22 for the ejector is also projecting on the top of the handle, close to the control button 12.

Figure 2:
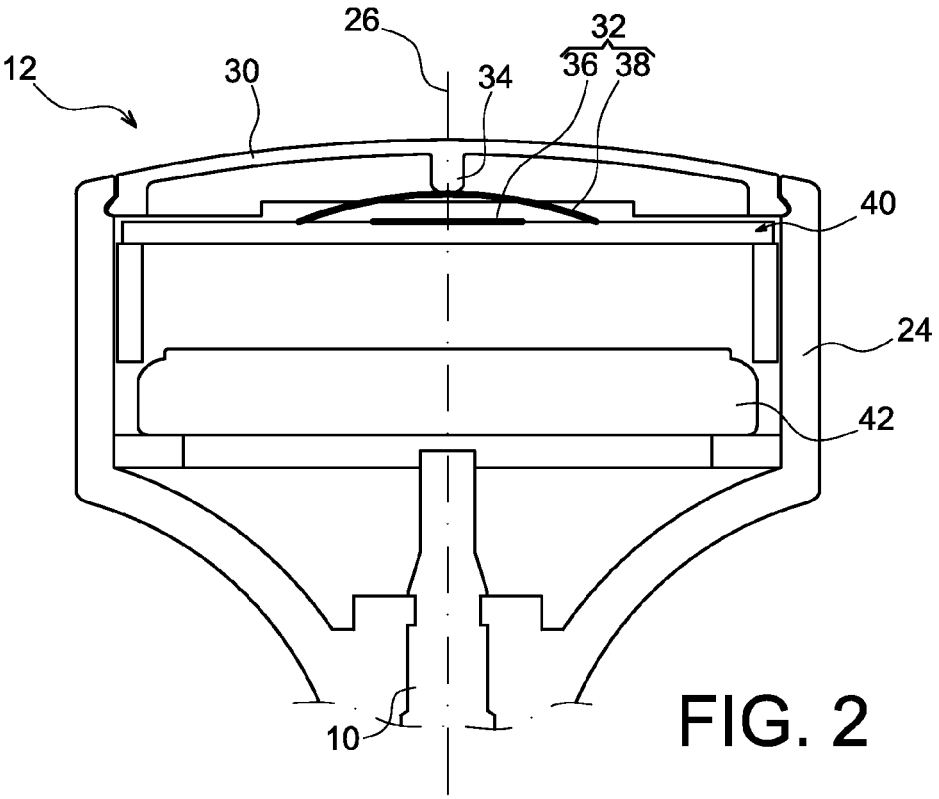
FIGS. 2 to 4 show the pipette button in the previous figure, its central part and its bottom part respectively.

FIG. 2 shows details of the control button 12.

It comprises an external envelope, of which the sidewall 24 is a shape of revolution with an axis corresponding to the longitudinal axis 26 of the pipette. Note that all elements of the pipette that will be described below are centred on this same axis 26. At its bottom end, the sidewall 24 is fixed to the control rod 10, while its top end supports a top part 30 shaped like a dome closing the plug 12.

More precisely, the hollow part of the dome 30 is facing downwards and therefore has its convex face facing upwards on which the operator will apply pressure with his thumb during pipetting. In other words, the dome 30 forms the part of the button on which the operator directly applies axial actuation pressure during a pipetting operation.

The dome 30 forms an integral part of the means for detecting when the pipette piston passes through a predetermined position as will be described in detail below. In the embodiment shown, all the above-mentioned means are integrated into the plug 12, therefore beginning with the dome 30 forming the top end of the plug and forming an integral part of the control means of a switch 32.

The control means also include a mobile actuation device 34, in the form of a pin centred on the axis 26 and extending along the direction of the axis. The pin 34 is fixed to the dome 30 that supports it on the inside as can be seen in FIG. 2. These two elements 30, 34 may be made from a single piece, preferably prefabricated from an appropriate elastic polymer material such as natural or synthetic rubber or thermoplastic elastomers, for example silicone rubber, polyurethane, etc.

The elastic/flexible nature of the dome 30 forming the pin support 34 is vital because its deformation will enable actuation of the switch 32 as will be described below.

The switch 32 is located under the pin 34 and it comprises a fixed electrical contact 36 supported by an electronic device 40 and a deformable electrical contact 38 in the shape of a dish, arranged in contact with and under the pin 34. This pin shown in FIG. 2 is shown in an inactive position that does not cause any switching.

The electronic device 40 that globally comprises a microprocessor and a transceiver is powered by a battery 42 located under the device, always on the inside of the outside wall 24, immediately above the top end of the control rod.

Figure 3:
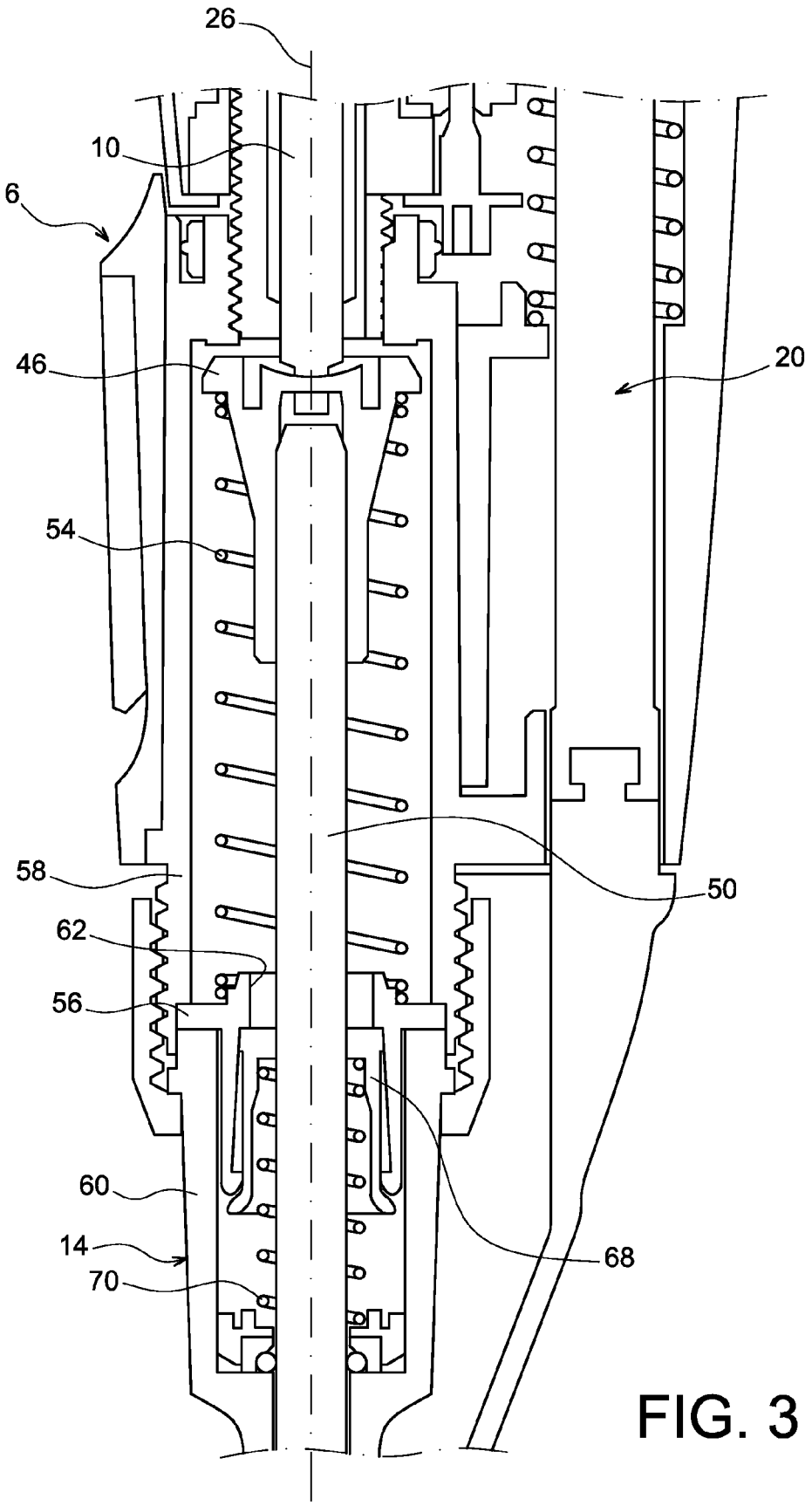

FIG. 3 shows a central part of the pipette comprising a portion of the handle 6 and a portion of the bottom part 14. The adopted design is conventional and is known to those skilled in the art, and therefore will only be described briefly.

Figure 4:
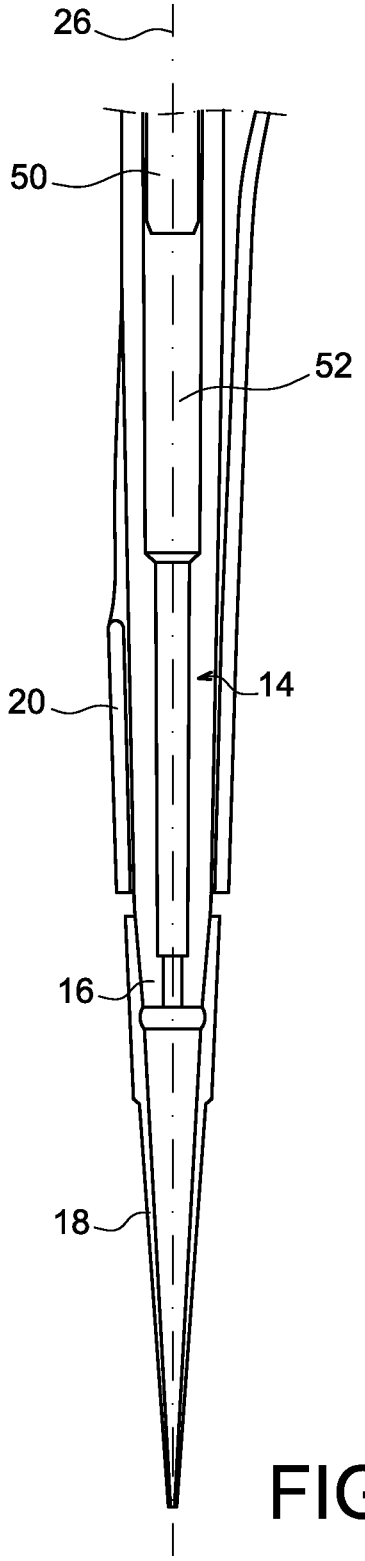

Near the top, the bottom part of the control rod 10 is surrounded by a device for adjustment of the volume to be sampled, known in itself. This bottom end is in contact with a part 46 acting as seating fixed to the top end of a piston 50, the bottom end of which is housed inside a suction chamber 52 shown in FIG. 4, communicating with the inside of the sampling cone 18.

The piston 50, free to slide along the direction of the axis 26 in the suction chamber, is held in the high position by a first compression spring 54, the top end of which is supported on a shoulder of the seat 46 and the bottom end of which is bearing on the shoulder of another seat 56 arranged close to the junction between the handle 6 and the bottom part 14. The seat 56 is fixed to the fixed shell 58 of the handle and is also fixed to the fixed shell 60 of the bottom part 14. The first spring 54 is usually called the liquid dispensing spring.

The seat 56 has an orifice 62 through which the piston 50 passes. There is a shoulder on this seat 56 facing downwards that stops a ring 68 in translation held in its high position by a second compression spring 70, the bottom end of which bears in the bottom of the shell 60. The second spring 70 is usually called the purge spring. Its stiffness is higher than the stiffness of the dispensing spring 54.

The detection means mentioned above are designed to detect when the piston 50 passes through the end of dispensing movement position, in other words at the time of the transition between the two movement distances, just before the second spring 70 started to deform. To achieve this, the stiffness of the dome 30 is adapted as a function of the stiffnesses of the springs 54, 70 such that the dome only deforms at the end of the dispensing movement, so as to actuate the switch to output a switching signal.

Thus, during a dispensing operation, the operator holding the handle 6 in his hand applies an axial actuation pressure on the button using his thumb. This displaces the control rod 10 downwards, which entrains the piston with it due to its bearing on the seat 46. At the beginning of the dispensing movement, the first spring 54 is loaded and compressed, but the pressure applied by the thumb on the button 12 is not sufficient to deform the dome 30. Therefore the electronic device does not record any data during this phase because the switch has not been actuated.

Figure 5:
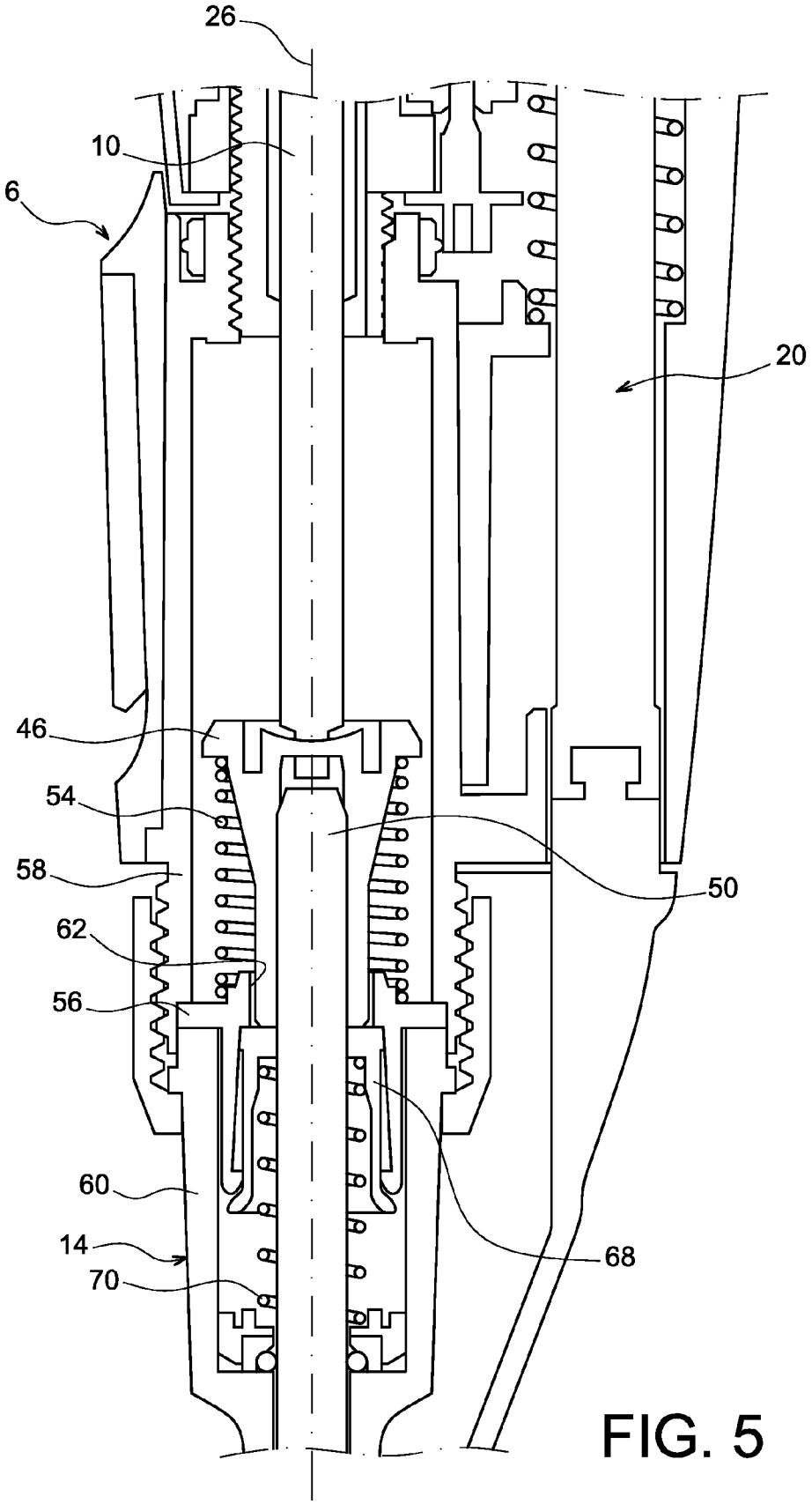
FIGS. 5 to 7 show the pipette in different configurations adopted during a pipetting operation.
Figure 6:
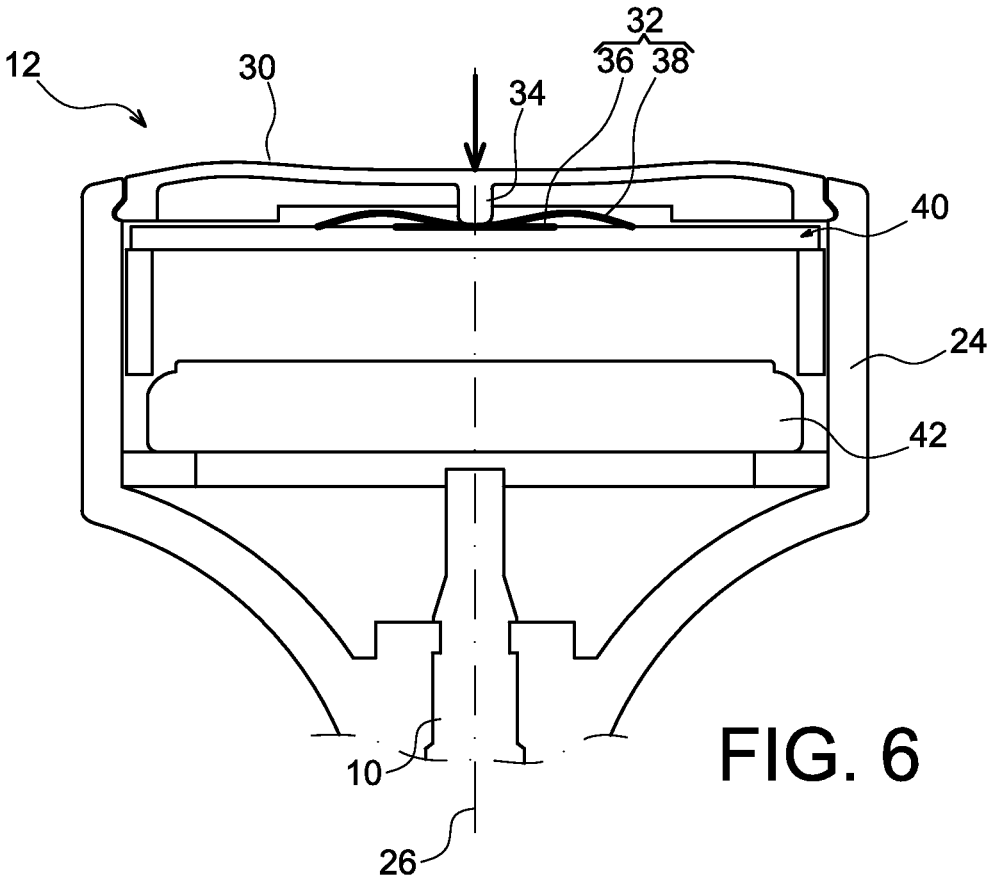

On the other hand, when the first spring 54 reaches the predetermined deformation level bringing the piston 50 to the end of its dispensing movement as shown in FIG. 5, the pipette is designed such that there is a sudden simultaneous deformation of the dome 30, still in response to the axial pressure applied by the operator as shown in FIG. 6.

The sudden deformation of the dome 30 that results in a touch sensation for the operator, moves the pin 34 downwards towards its actuation position shown in FIG. 6. The sudden deformation of the dome 30 causes an inversion of its hollow concave face which is then facing upwards. As the pin 34 moves, the pin causes deformation of the shell 38 that has negligible mechanical resistance, so that it bears in contact with the fixed contact 36 of the switch, thus generating a switching signal that is sent to the electronic device 40.

For information, the invention may be arranged such that the switching signal is output as soon as the electrical contact exceeds a given duration, for example 300 μs.

Figure 7:
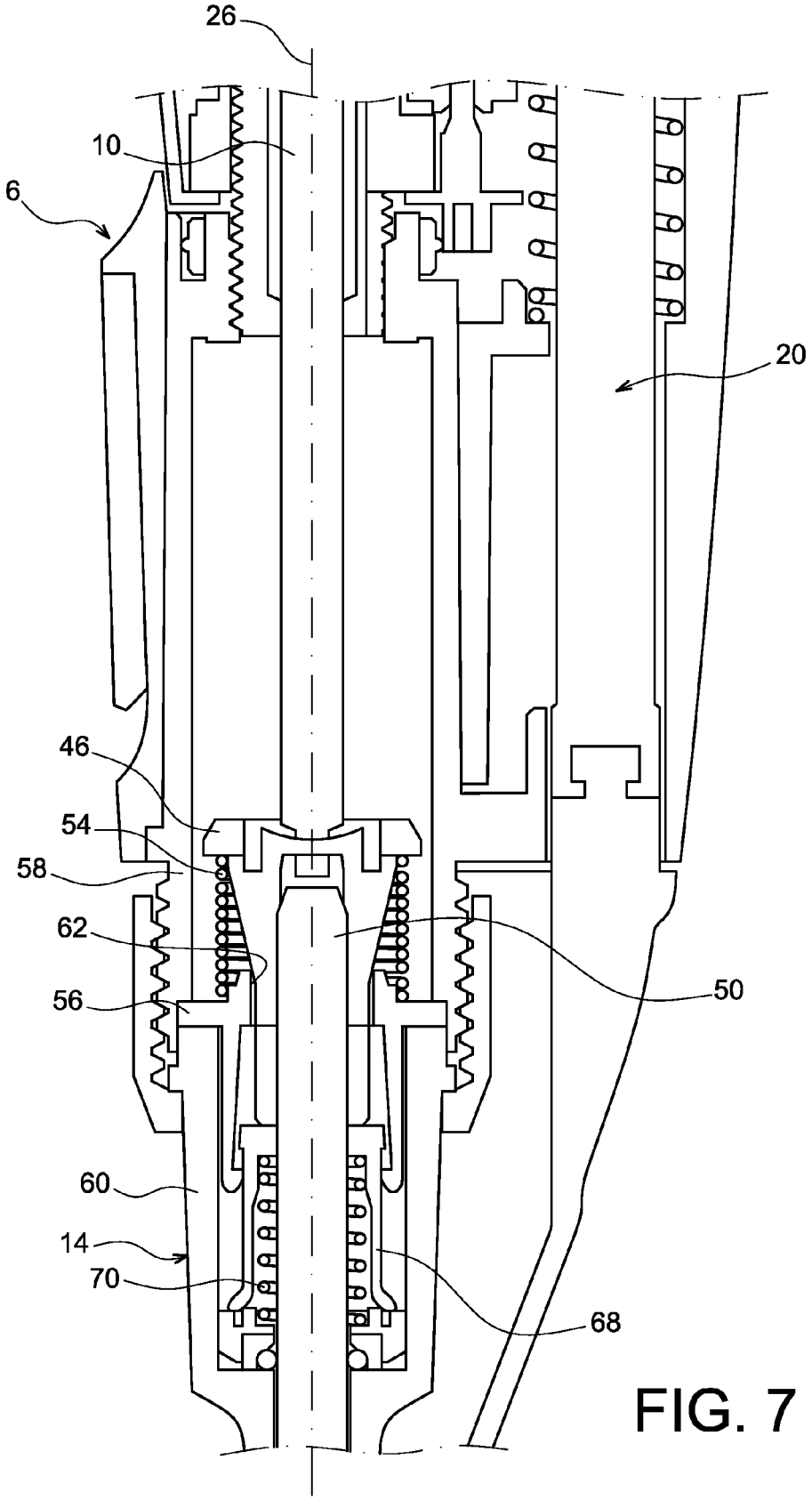

The operator then continues to increase the pressure on the button to complete the purge movement causing compression of the second spring 70, until the piston arrives at a low point shown in FIG. 7. Note that the first spring continues to be progressively stressed throughout this purge movement. The compression of the second spring 70 is generated by a sleeve prolonging the seat 46 downwards and passing through the orifice 62, pressing on the seat 68.

Once the pipetting operation has been completed, the operator releases the pressure that causes the different elements to be relaxed successively in the opposite order to the order described.

When the switching signal is output to the electronic device 40, several actions may be generated like those described above. One of the preferred actions among these actions is the transmission of a transmission signal to a receiver remote from the pipette through a wireless link and through the transmitter.

Figure 8:
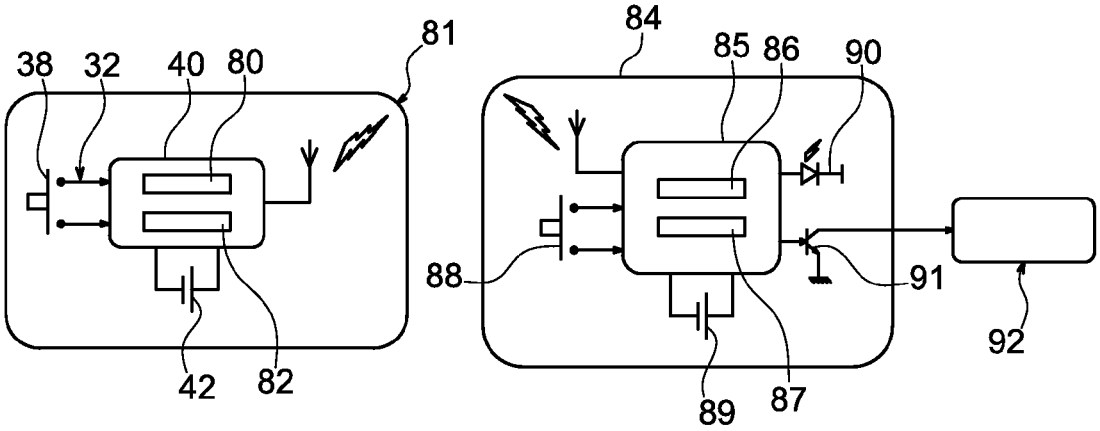
FIG. 8 is a diagram showing the different pipette components necessary to output transmission signals, and the different components that will be fitted on a device remote from the pipette to receive transmission signals.

FIG. 8 shows an example of equipment used for such wireless communication, in this case by RF radiofrequency. The detection means 81 installed on the pipette button have already been described above. They include the electronic device 40 fitted with the microprocessor 80 and the transceiver 82. They also include the switch 32 and the electrical power supply battery 42. The receiver 84 provided on a device arranged at a distance from the pipette and designed to communicate with it, includes an electronic device 85 on which there is a microprocessor 86 and a transceiver 87. It also includes a pairing control 88, an electrical power supply battery 89 and possibly a receiver status LED 90. There is also a connection 91, for example of the USB type, to connect it to the remote device 92 that in this case is preferably a lighting device to facilitate pipetting shown in FIG. 9.

Figure 9:
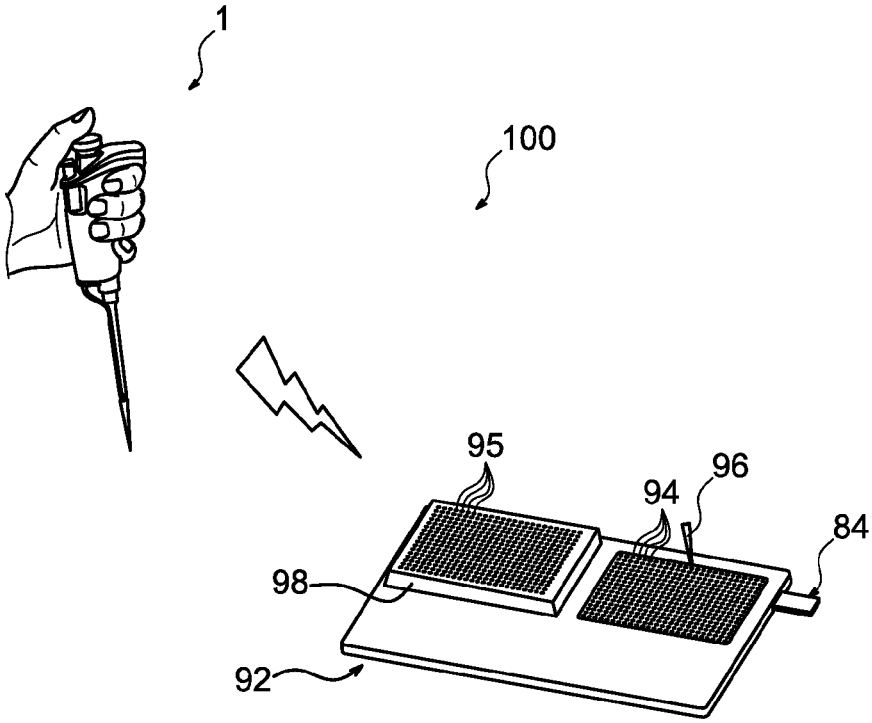
FIG. 9 shows a system comprising a sampling pipette and a lighting device to help dispense liquid in the wells of at least one microtitration plate designed to be supported on the lighting device.

This FIG. 9 shows a system 100 comprising the pipette 1 and the lighting device 92 helping to dispense liquid into the wells of at least one titration device, that will rest on this lighting device in a known manner. For example it may be a microplate 98 like that positioned on the left part of the lighting device 92 in FIG. 9. This lighting device will communicate wirelessly with the pipette, by RF using the means described in FIG. 8.

The liquid sampled by a pipette may be dispensed into the wells of the microtitration plate 98 that rests on the top part of the lighting device with a matrix of light points 94 corresponding to the matrix formed by the wells 95 on the microplate, in a manner known to those skilled in the art. The liquid is then dispensed in sequence in the different wells, which are very small and very numerous. The device 92 usually illuminates the well to be filled through the appropriate light point 94, after the light point 94 of the well previously filled with liquid has been switched off, to limit risks of operator error. Lighting may be done for example using LEDs located under the microplate that is at least partially transparent.

The operator usually has a pedal control to order displacement of lighting from one well to the next. The control pedal is then actuated after each well has been filled. With this invention, successive lighting of the wells according to a predetermined order memorised by the microplate takes place automatically after each transmission signal received by the receiver 84 connected to the lighting device 92 has been sent. In other words, during pipetting, as soon as the dome has suddenly deformed, the sequence of events described above occurs until the light 96 is seen to change to illuminate the next well to be filled. Obviously other illumination configurations are possible without going outside the scope of the invention.

Obviously, those skilled in the art can make various modifications to the invention described above as non-limitative examples.

The invention claimed is:

1. A manually actuated sampling pipette, comprising:

a control rod having a lower end which controls displacement of a piston housed in a suction chamber of the pipette and free to slide in said suction chamber, a top end of the control rod being provided a control button that is moved by axial actuation pressure of an operator so that the piston undergoes a dispensing movement during which a first compression spring is loaded, followed by a purge movement during which a second compression spring is loaded;

an electronic device that receives a switching signal notifying passage of the piston through a predetermined position along its dispensing distance or its purge distance, said position being a position in which said first and/or second compression springs have a predetermined deformation; and a switch that outputs said switching signal to said electronic device when activated by switching control means, wherein said control means comprises a mobile actuation device fixed to an elastic support capable of deforming elastically under the effect of said axial actuation pressure applied by the operator on the control button, said pipette being constructed such that elastic deformation of the elastic support occurring during the bringing of the mobile actuation device from an inactive position into an actuation position, is caused only when an intensity of said axial pressure is greater than or equal to an intensity which brings said first and/or second compression springs to their respective predetermined strain level.

2. The sampling pipette according to claim 1, wherein said elastic support is constructed to deform suddenly when the mobile actuation device moves from the inactive position into the actuation position.

3. The sampling pipette according to claim 1, wherein said elastic support is dome-shaped with a hollow part of the dome facing a bottom of the pipette.

4. The sampling pipette according to claim 1, wherein said elastic support is integrated into said control button and forms a part of the button on which the operator directly applies the axial actuation pressure during a pipetting operation.

5. The sampling pipette according to claim 1, wherein said mobile actuation device is fixed to the elastic support and is a pin.

6. The sampling pipette according to claim 1, wherein at least one of the following are integrated into the control button:

said electronic device;

said switch;

said control means; and an electrical power supply to the electronic device.

7. The sampling pipette according to claim 1, wherein said electronic device comprises a microprocessor.

8. The sampling pipette according to claim 7, wherein the electronic device further comprises a transmitter.

9. The sampling pipette according to claim 1, wherein said electronic device is designed to perform at least one of the following actions:

store a number of switching signals output by said switch;

control an action following the output of the switching signal by said switch;

control a change to the display on a screen provided on the pipette after said switch has output the switching signal; and use a transmitter to send a transmission signal to a receiver located at a distance from the pipette through a wireless link, after the switch has output the switching signal.

10. The sampling pipette according to claim 9, wherein said electronic device is also designed to store data related to said switching signals.

11. The sampling pipette according to claim 1, wherein said predetermined position of the piston corresponds to a transition position between the dispensing movement and the purge movement.

12. A system comprising:

a sampling pipette comprising a control rod having a lower end which controls displacement of a piston housed in a suction chamber of the pipette and free to slide in said suction chamber, and a top end of the control rod being provided with a control button that is moved by axial actuation pressure of an operator so that the piston undergoes a dispensing movement during which a first compression spring is loaded, followed by a purge movement during which a second compression spring is loaded, an electronic device that receives a switching signal notifying passage of the piston through a predetermined position along its dispensing distance or its purge distance, said predetermined position being a position in which said first and/or second compression spring have a predetermined deformation, and a switch that outputs said switching signal to said electronic device when activated by switching control means, wherein said control of means comprises a mobile actuation device fixed to an elastic support capable of deforming elastically under the effect of said axial actuation pressure applied by the operator on the control button, said pipette being constructed such that elastic deformation of the elastic support occurs when the mobile actuation device moves from an inactive position into an actuation position, and is caused only when an intensity of said axial pressure is greater than or equal to an intensity which brings said first and/or second compression springs to their respective predetermined strain level, and a lighting device for dispensing liquid in wells of at least one titration device supported on the lighting device, said lighting device constructed to illuminate said wells successively in response to the transmission signals sent through a wireless link by said electronic device of the pipette.

13. A manually actuated control button for a sampling pipette, comprising:

a control button adapted to control a pipette and disposed thereon, and being fixed to a top end of a control rod of the pipette, a bottom end of said control rod controlling a displacement of a pipette piston, said control button having atop surface on which an operator can apply an axial actuation pressure to perform a dispensing movement followed by a purging movement of the piston, wherein said button comprises an electronic device and a switch which, when actuated by a switching control means also integrated into the button, outputs a switching signal to said electronic device, said switching control means comprising a mobile actuation device fixed to an elastic support capable of deforming elastically under the effect of said axial actuation pressure applied by the operator on the control button, said button being designed such that elastic deformation of said support which occurs during the bringing of the mobile device from an inactive position to an actuation position, is only caused when an intensity of said axial pressure applied on said top surface is greater than a predetermined intensity.

14. A manually actuated sampling pipette, comprising:

a control rod having a lower end which controls displacement of a piston housed in a suction chamber of the pipette and free to slide in said suction chamber, a top end of the control rod being provided with a control button that is moved by axial actuation pressure of an operator so that the piston undergoes a dispensing movement during which a first compression spring is loaded, followed by a purge movement during which a second compression spring is loaded;

a processor that receives a switching signal notifying passage of the piston through a predetermined position along its dispensing distance or its purge distance, said position being a position in which said first and/or second compression springs have a predetermined deformation; and a switch that outputs said switching signal to said processor when activated by a pin, wherein said pin is fixed to an elastic support capable of deforming elastically under the effect of said axial actuation pressure applied by the operator on the control button, and wherein said pipette is constructed such that elastic deformation of the elastic support occurring during movement of the mobile actuation device from an inactive position into an actuation position, is caused only when an intensity of said axial pressure is greater than or equal to an intensity which brings said first and/or second compression springs to their respective predetermined strain level.

15. The spring pipette according to claim 14, wherein said elastic support is dome-shaped with a hollow part of the dome facing a bottom of the pipette.

16. The sampling pipette according to claim 14, wherein said elastic support is integrated into said control button and forms a part of the button on which the operator directly applies the axial actuation pressure during a pipetting operation.

17. The sampling pipette according to claim 14, wherein at least one of the following are integrated into the control button:

said processor;

said switch;

a transmitter; and an electrical power supply to the processor.

18. The sampling pipette according to claim 14, wherein said processor is configured to perform at least one of the following actions:

store a number of switching signals output by said switch;

control an action following the output of the switching signal by said switch;

control a change to the display on a screen provided on the pipette after said switch has output the switching signal; and send a signal using a transmitter to a receiver located at a distance from the pipette through a wireless link, after the switch has output the switching signal.

19. The sampling pipette according to claim 14, wherein said predetermined position of the piston corresponds to a transition position between the dispensing movement and the purge movement.

* * * * *